US009095781B2

(12) United States Patent
Tiefel et al.

(10) Patent No.: US 9,095,781 B2
(45) Date of Patent: Aug. 4, 2015

(54) INVERTIBLE POP ACTION TOY AND ITS ASSOCIATED METHOD OF MANUFACTURE

(76) Inventors: Simeon E. Tiefel, Woodinville, WA (US); Webb T Nelson, Woodinville, WA (US); Mark J. Chernick, Woodinville, WA (US)

( * ) Notice: Subject to any disclaimer, the term of this patent is extended or adjusted under 35 U.S.C. 154(b) by 273 days.

(21) Appl. No.: 13/314,157

(22) Filed: Dec. 7, 2011

(65) Prior Publication Data

US 2013/0149936 A1 Jun. 13, 2013

(51) Int. Cl.
*A63H 33/00* (2006.01)
*A63H 37/00* (2006.01)

(52) U.S. Cl.
CPC ..... *A63H 37/005* (2013.01)

(58) Field of Classification Search
CPC ..... A63H 37/005; A63H 11/06; A63F 9/0406
USPC ..... 446/486, 396, 399, 400, 415, 385
See application file for complete search history.

(56) References Cited

U.S. PATENT DOCUMENTS

| | | | | |
|---|---|---|---|---|
| 1,677,122 | A * | 7/1928 | Johnson | 446/14 |
| 1,962,927 | A * | 6/1934 | De Bats | 446/14 |
| 2,153,957 | A | 4/1939 | Davis | |
| 4,334,385 | A * | 6/1982 | Melin et al. | 446/46 |
| 4,431,196 | A * | 2/1984 | Kutnyak | 473/588 |
| 4,802,880 | A * | 2/1989 | Shaw | 273/317.5 |
| 5,213,538 | A | 5/1993 | Willett | |
| 5,366,403 | A * | 11/1994 | Weiss | 446/46 |
| 6,488,559 | B1 * | 12/2002 | Hintz | 446/311 |
| 7,335,085 | B2 * | 2/2008 | Lyman | 446/486 |
| 7,803,033 | B1 | 9/2010 | Walterscheid | |
| 2004/0107431 | A1 * | 6/2004 | Wilcoxson et al. | 720/718 |

* cited by examiner

*Primary Examiner* — Vishu Mendiratta
(74) *Attorney, Agent, or Firm* — LaMorte & Associates, P.C.

(57) ABSTRACT

A pop action toy assembly having a disc with a top surface, a bottom surface, a peripheral edge. The disc is formed to have a first stable configuration and a second stable configuration, wherein the disc can be inverted between the two stable configurations. The disc assumes the first stable configuration when symmetrically bent around a first axis so that its top surface is concave. The disc assumes its second stable configuration when symmetrically bent around a second axis so that the top surface is convex. The first axis and second axis are in the same plane and are generally perpendicular to each other. The invertible pop action toy is manually set into its second stable configuration. The invertible pop action toy is then dropped against a hard surface. Upon impact with the surface, the invertible pop action toy snaps back into its first stable configuration.

16 Claims, 5 Drawing Sheets

INVERTIBLE POP ACTION TOY AND ITS ASSOCIATED METHOD OF MANUFACTURE

BACKGROUND OF THE INVENTION

1. Field of the Invention

In general, the present invention relates to toys that are spring loaded and pop up into the air when activated. More particularly, the present invention relates to toys having an invertible spring element that stores the energy needed to pop the toy into the air.

2. Prior Art Description

There are many objects that are only stable in either a resting condition or an inverted condition. In the toy industry, the most common of such objects is the half-ball. Rubber balls were originally made from two hemispherical pieces of rubber that were glued together to form the shape of the ball. As the balls were played with, it was not uncommon for the two halves of the ball to separate. A child, playing with the ball would then have two half balls. Half-balls were so common that many childhood games required the use of a "half-ball".

One game played with a half-ball involved inverting the half-ball so that it would pop. When a half-ball is inverted it stores energy like a spring. If the inverted half-ball were dropped or touched, the half-ball would pop back into its hemispherical shape, thereby releasing the stored energy. The popping action of the half-ball would cause the half-ball to fly up into the air.

Recognizing the play value of half-balls, toy manufacturers began to intentionally manufacture half-balls and configure the half-balls to optimize the popping action. Such half-balls are exemplified by U.S. Pat. No. 2,153,957 to Davis, entitled Jumping ball, and U.S. Pat. No. 7,803,033 to Walterscheid, entitled Pop Action Toy. Furthermore, secondary objects, such as dolls and superheroes have been attached to half-balls. In this manner, when the half-ball pops and flies into the air, so does the toy character. Half-balls that carry secondary characters are exemplified by U.S. Pat. No. 5,213,538 to Willett, entitled Pop-Action Bouncing Doll.

Half-ball popping toys have certain problems that are inherent with their design. If a half-ball is made from a material that is too thick or has too high a durometer, then the half-ball will not remain inverted for long. As soon as the half-ball is inverted, the half-ball begins to bend back toward its original hemispherical shape. The half-ball will therefore pop back into its hemispherical shape only a few moments after it is inverted. Conversely, if a half-ball is made too thin or with a material that has too low a durometer, then the half ball will not store much energy when it is inverted and will not pop into the air. Consequently, half-balls have to be made using a substantial volume of high quality rubber or synthetic rubber. Furthermore, half-balls have to be made using precise manufacturing conditions. For these reasons, half-balls that are designed to be inverted and pop up cannot be manufactured inexpensively.

The present invention represents an improvement in the art of invertible pop action toys. The present invention replaces the body of a rubber half-ball with a pre-bent flat spring. The result is an invertible pop action toy that can be manufactured far easier and far more economically than can a rubber pop action toy. The details of the present invention are described and claimed below.

SUMMARY OF THE INVENTION

The present invention is a pop action toy assembly. The pop action toy assembly has a disc. The disc has a top surface, a bottom surface, a peripheral edge. The disc is formed to have a first stable configuration and a second stable configuration, wherein the disc can be inverted between the two stable configurations. The disc assumes the first stable configuration when symmetrically bent around a first axis so that its top surface is concave. The disc assumes its second stable configuration when symmetrically bent around a second axis so that the top surface is convex. The first axis and second axis are in the same plane and are generally perpendicular to each other.

An elastomeric bumper is affixed to the disc and covers the peripheral edge.

The invertible pop action toy is manually set into its second stable configuration. The invertible pop action toy is then dropped against a hard surface. Upon impact with the surface, the invertible pop action toy snaps back into its first stable configuration. The energy released upon the inversion is enough to pop the toy back into the air. As a result, the invertible pop action toy pops back up into the air when dropped against a surface.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention invertible pop action toy can be configured into a variety of different geometric shapes, such as ovals, polygons and the like, the present invention is particularly well adapted for being configured into a round shape. Accordingly, for the purpose of illustration and description, the present invention invertible pop action toy has been configured into a round shape. This embodiment is selected in order to set forth the best mode contemplated for the invention. The illustrated embodiment, however, is merely exemplary and should not be considered a limitation when interpreting the scope of the appended claims.

Figure 1:
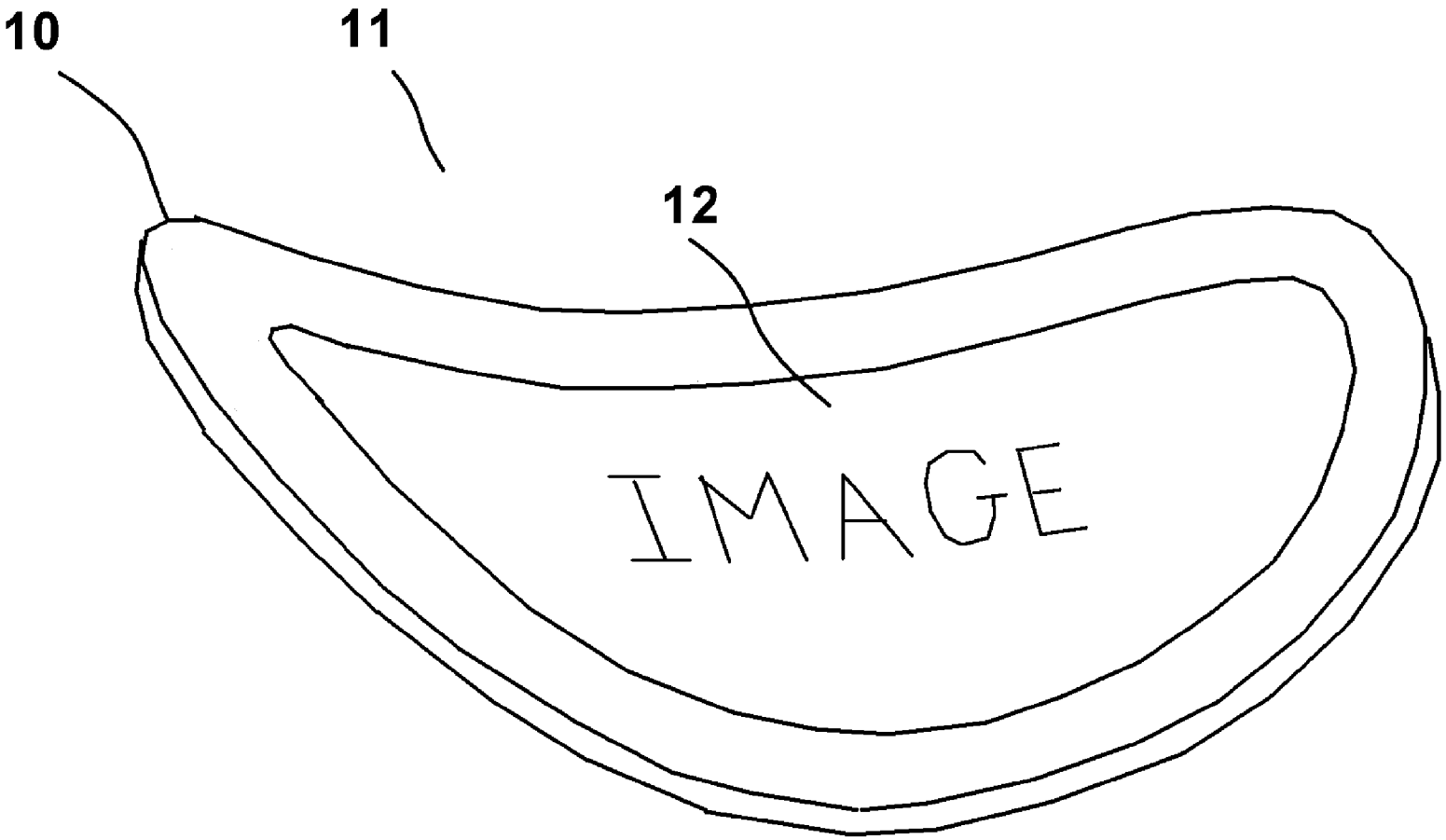
FIG. 1 is a perspective view of an exemplary embodiment of a pop action toy assembly in its first stable configuration.
Figure 2:
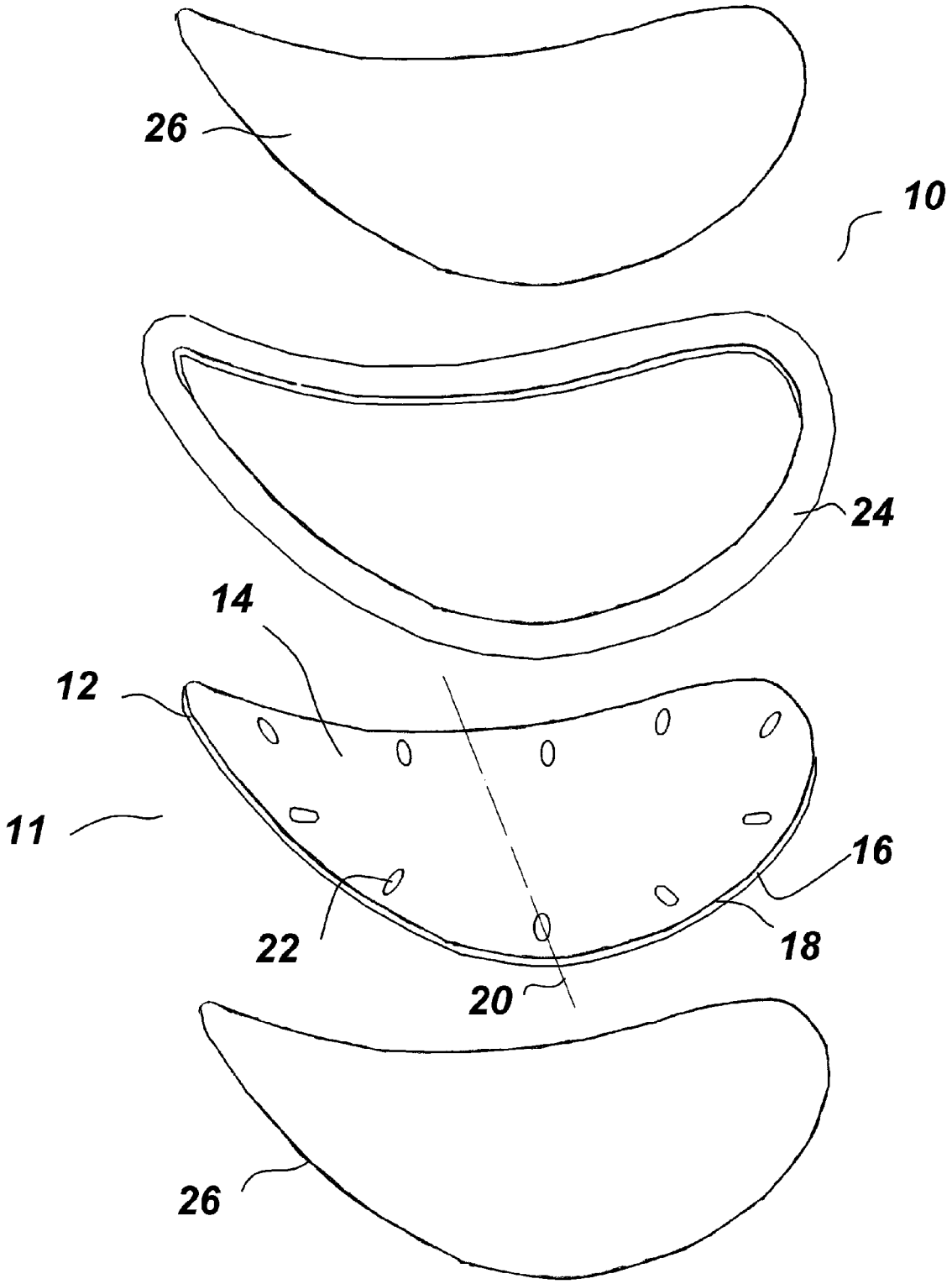
FIG. 2 is an exploded view of the embodiment of FIG. 1.

Referring to FIG. 1 in conjunction with FIG. 2, an invertible pop action toy 10 is shown in its first stable configuration 11. The invertible pop action toy 10 has a body made from a circular metal disc 12. The metal disc 12 has a top surface 14, a bottom surface 16 and a peripheral edge 18. A first imaginary axis 20 bisects the metal disc 12 into even halves. The metal disc 12 is bent into a curved shape around the first imaginary axis 20, so that the first imaginary axis 20 extends along the apex of a bend.

The metal of the metal disc 12 is hardened to serve as a flat spring. The metal disc 12 is formed into the first stable configuration 11 and resists being deformed out of the first stable configuration 11 by a spring bias provided by the metal of the metal disc 12.

The metal disc 12 is thin and has a preferred sheet metal gauge thickness of between 16 and 12. The metal disc 12 is preferably stamped from a sheet of tempered steel. Accordingly, the peripheral edge 18 of the metal disc 12 may be sharp. To eliminate any chances of injury, holes 22 are punched through the metal disc 12 near the peripheral edge 18 of the metal disc 12. An elastomeric bumper 24 is then molded around the peripheral edge 18 of the metal disc 12. The molded material of the elastomeric bumper 24 extends through the holes 22 in the metal disc 12 and mechanically interconnects the elastomeric bumper 24 to the metal disc 12. The result is a soft, safe elastomeric bumper 24 that surrounds the peripheral edge 18 of the metal disc 12 and prevents any direct contact with the peripheral edge 18. Although the elastomeric bumper 24 can have any thickness, it is preferred that the elastomeric bumper 24 is at least twice as thick as the gauge of the metal disc 12.

The metal disc 12 has part of its top surface 14 and bottom surface 16 exposed within the confines of the elastomeric bumper 24. When the invertible pop action toy 10 is in its first stable configuration 11, as is shown in FIG. 1 and FIG. 2, the top surface 14 is concave and the bottom surface 16 is convex. The top surface 14 and the bottom surface 16 can be printed upon or otherwise decorated to make the invertible pop action toy 10 more visually appealing. In the preferred embodiment shown, a decorative layer 26 is adhesively bonded to the top surface 14 and the bottom surface 16 of the invertible pop action toy 10. A preferred decorative layer 26 is a lenticular film that may or may not contain a holographic image. The decorative layer 26 serves two primary functions. First, the decorative layer 26 adds to the aesthetics of the invertible pop action toy 10. Second, the decorative layer 26 serves as a protective cover to the metal disc 12. The decorative layer 26 prevents the metal disc 12 from oxidation. Furthermore, should the metal disc 12 ever fatigue and develop a crack, the decorative layer 26 would cover the crack and prevent a person from directly touching any sharp edge exposed by the crack.

Figure 3:
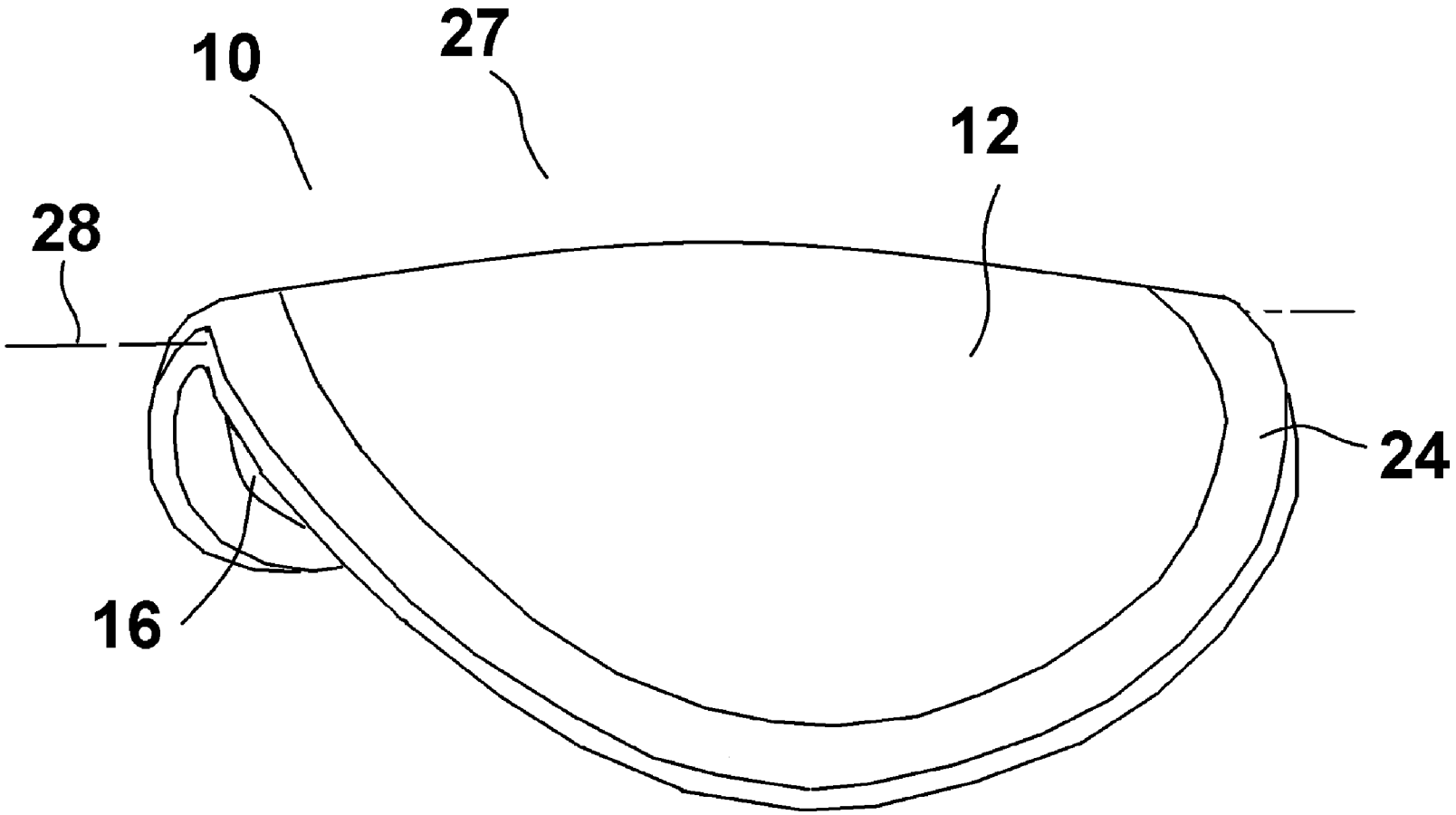
FIG. 3 is a perspective view of the exemplary pop action toy assembly shown in its inverted second stable configuration.

Referring now to FIG. 3, it can be seen that the metal disc 12 can be selectively inverted out of its first stable configuration (11, FIG. 1) and into a second stable configuration 27. To change the metal disc 12 into its second stable configuration 27, the metal disc 12 is manually deformed about a second imaginary axis 28 that is perpendicular or nearly perpendicular to the first imaginary axis 20. When deformed into its second stable configuration 27, the invertible pop action toy 10 becomes physically stable and can remain in that second stable configuration 27 indefinitely. The second imaginary axis 28 bisects the metal disc 12 into two even halves. In the second stable configuration 27, the metal disc 12 is symmetrically bent about the second imaginary axis 28 with the second imaginary axis 28 being at the apex of the bend. In the second stable configuration 27, the top surface 14 of the metal disc 12 is now convex, while the bottom surface 16 is concave.

Referring to both FIG. 1 and FIG. 3, it will be understood that the invertible pop action toy 10 can be selectively manipulated into either the first stable configuration 11 of FIG. 1 or the second stable configuration 27 of FIG. 3. The metal disc 12 is only physically stable when it is in either its first stable configuration 11 or its second stable configuration 27. At all configurations therebetween, the invertible pop action toy 10 is unstable and will automatically revert into either the first stable configuration 11 or the second stable configuration 27.

The metal disc 12 within the invertible pop action toy 10 is formed with a first spring bias that directs the metal disc 12 into its first stable configuration 11. Likewise, the metal disc 12 is formed with a second spring bias that directs the metal disc into its second stable configuration 27. These two spring biases oppose each other. Accordingly, when the invertible pop action toy 10 is in either its first stable configuration 11 or its second configuration 27, the invertible pop action toy 10 stores spring energy that wants to change the inventible pop action toy 10 into its other configuration. This stored energy can be used to cause the invertible pop action toy 10 to pop into the air.

When the invertible pop action toy 10 is manually moved into either its first stable configuration 11 or its second stable configuration 27, energy is stored within the metal disc 12. Because the invertible pop action toy 10 is unstable in all configurations other than its first stable configuration 11 and its second stable configuration 27, it will be understood that stored spring energy can be released by inverting the invertible pop action toy 10 between its stable configurations. There is a deformation threshold between the first stable configuration 11 and the second stable configuration 27. The deformation threshold favors the first stable configuration 11. If the invertible pop action toy 10 is in its second stable threshold 27 and is deformed past that deformation threshold, the invertible pop action toy will instantly invert back into its first stable configuration 11. This inversion happens automatically and with great speed since it releases the spring energy stored in the metal disc 12.

Figure 4:
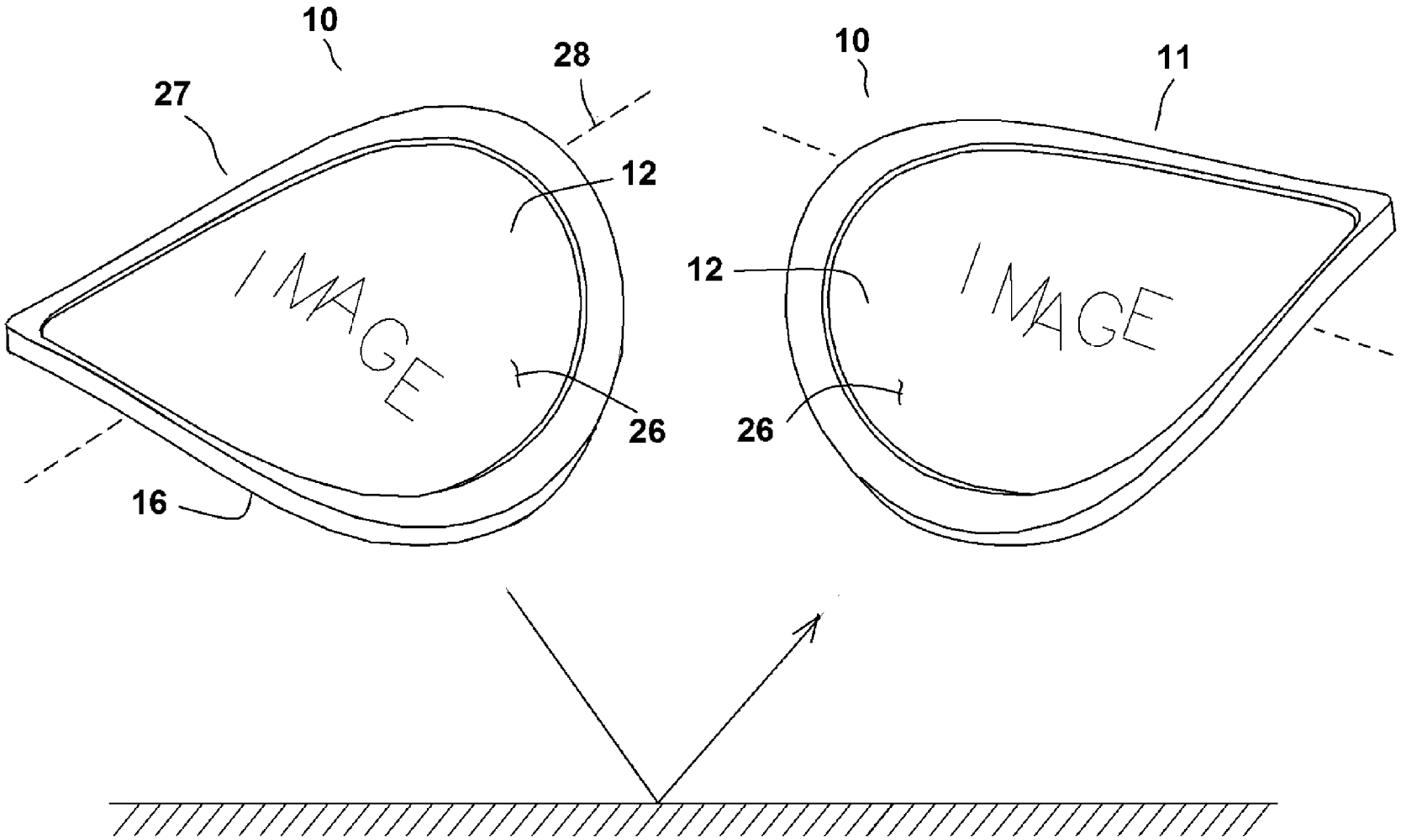
FIG. 4 shows the exemplary pop action toy assembly changing from its inverted second stable configuration to its first stable configuration upon impact with a surface.

Referring now to FIG. 4 it will be understood that the invertible pop action toy 10 can be caused to deform past the deformation threshold in many ways. For example, the invertible pop action toy 10 can be manually depressed. However, it is preferred than the force of an impact with a hard surface is sufficient to cause the invertible pop action toy 10 to change configurations. That is, if the invertible pop action toy 10 is manually deformed into its second stable configuration 27 and the invertible pop action toy 10 is dropped against a hard surface, then the invertible pop action toy 10 will instantly invert into its first stable configuration 11 at the moment of impact. As the invertible pop action toy 10 inverts between configurations, the shape of the metal disc 12 changes. The changing of shape can cause the metal disc 12 to strike the impacted surface. This impact can propel the invertible pop action toy 10 back into the air. Consequently, the inventible pop action toy 10 can pop back up into the air when it is dropped against a surface.

It was earlier mentioned that the decorative layer 26 coving the metal disc 12 can be a lenticular film and may even contain a holographic image. As the invertible pop action toy 10 inverts, the shape of the top surface 14 and the bottom surface 16 change. This can cause the lenticular film to present a different appearance. Accordingly, by looking at the decorative layer 26, a person can visually ascertain whether the invertible pop action toy 10 is in its first stable configuration 11 or its second stable configuration 27.

Figure 5:
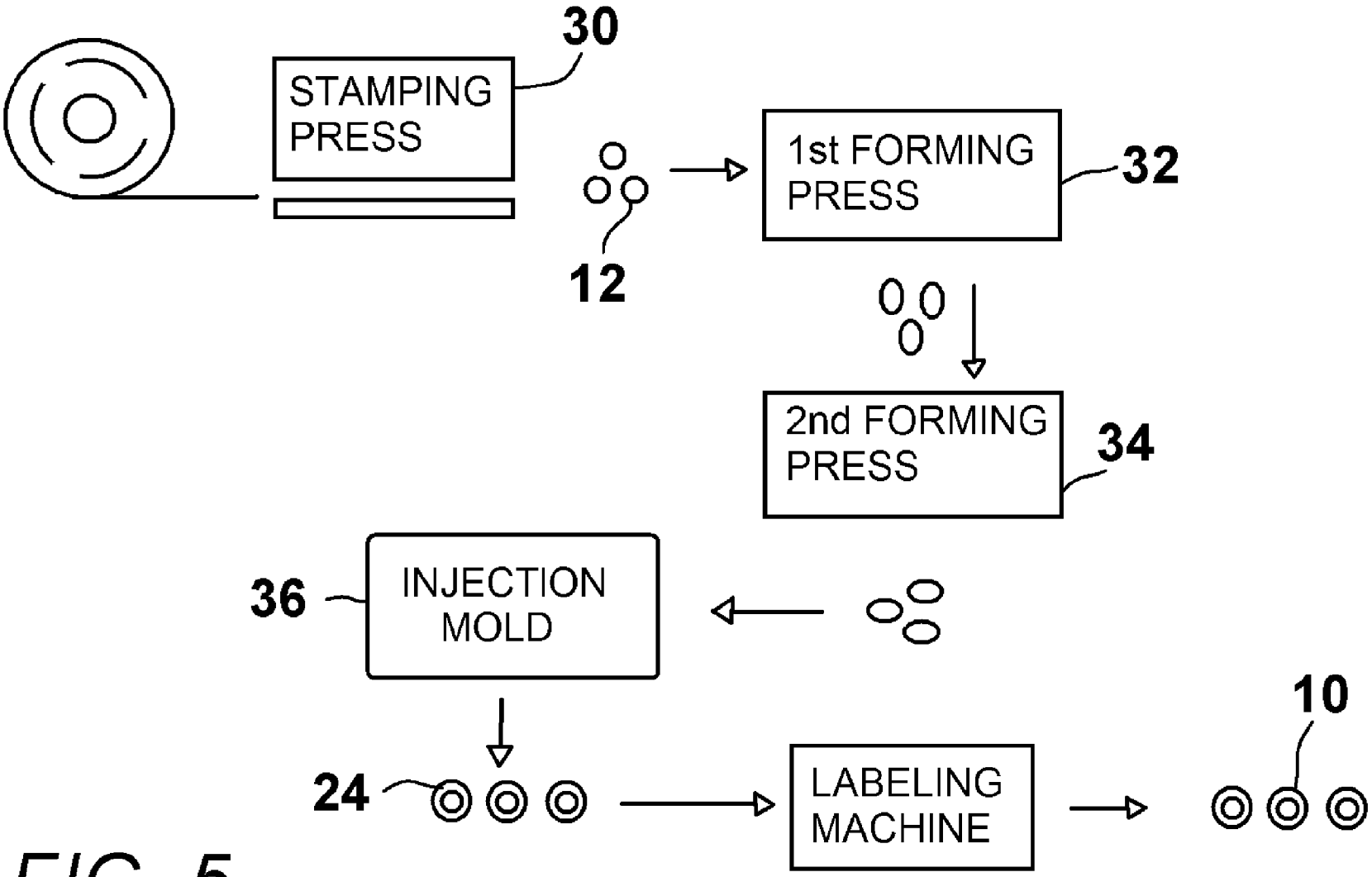
FIG. 5 is a schematic outlining an exemplary method of manufacture for the invertible pop action toy.

Referring now to FIG. 5 in conjunction with FIG. 2, an exemplary method of manufacturing the invertible pop action toy 10 is explained. Initially, the metal discs 12 are cut from a sheet of tempered spring steel using a stamping press 30. The metal disc 12 is then set in a first forming press 32 that deforms the metal disc 12 into its first stable configuration with enough force to create permanent deformation of the metal. The metal disc 12 is then placed into a second forming press 34 that shapes the metal disc 12 into its second stable configuration. Again, enough force is used to create permanent deformation of the metal.

The metal disc 12 is then placed in an injection molding machine 36 that molds the elastomeric bumper 24 around its peripheral edge 18. Lastly, decorative layers 26 are applied to the top surface 14 and the bottom surface 16 of the exposed metal disc 12 to create the final invertible pop action toy 10.

It will be understood that the embodiment of the present invention that is illustrated and described is merely exemplary and that a person skilled in the art can make many variations to that exemplary embodiment. For instance, the shape and size of the metal disc can be varied. The shape and size of the elastomeric bumper can also be varied. All such variations, modifications and alternate embodiments are intended to be included within the scope of the present invention as defined by the claims.

What is claimed is:

1. An invertible pop action toy assembly, comprising:

a disc having a top surface, a bottom surface, a peripheral edge and only two stable configurations wherein said two stable configurations includes a first stable configuration and a second stable configuration, wherein said disc is in said first stable configuration when symmetrically bent around a first axis line that bisects said top surface between points on said peripheral edge so that said top surface is curved about said first axis line into a first curved shape having a first apex, wherein said first axis line extends along said first apex, and wherein said disc is in said second stable configuration is symmetrically bent around a second axis line so that said top surface is curved about said second axis line into a second curved shape having a second apex, wherein said second axis line extends along an second apex, and wherein said first axis line and said second axis line are perpendicular; wherein the disc is invertible between said first stable configuration and said second stable configuration;

an elastomeric bumper affixed to said disc and covering said peripheral edge.

2. The assembly according to claim 1, further including a first layer of protective material covering said at least a portion of said top surface and a second layer of protective material covering at least a portion of said bottom surface.

3. The assembly according to claim 2, wherein said first layer of protective material and said second layer of protective material are lenticular films.

4. The assembly according to claim 1, wherein said disc is metal.

5. The assembly according to claim 4, wherein said metal is tempered steel.

6. The assembly according to claim 4, wherein said disc is between 16 gauge and 12 gauge thick.

7. The assembly according to claim 1, wherein said disc has a plurality of holes formed therethrough proximate said peripheral edge.

8. The assembly according to claim 7, wherein said elastomeric bumper is molded through said plurality of holes.

9. An invertible pop action toy assembly, comprising:

a circular disc having a top surface, a bottom surface, and a peripheral edge, said circular disc being form biased into a first stable configuration and a second stable configuration, wherein when in said first stable configuration said disc is symmetrically bent around a first axis line that bisects said disc between points on said peripheral edge so that said disc is curved about said first axis line into a first curved shape having a first apex, wherein said first axis line extends along an first apex, and when in said second stable configuration said disc is symmetrically bent around a second axis line so that said disc is curved about said second axis line into a second curved shape having a second apex, wherein said second axis line extends along said second apex, and wherein said first axis line is perpendicular to said second axis line, and wherein said disc is invertible between said first stable configuration and said second stable configuration, and wherein said disc is physically unstable in all configurations other than said first stable configuration and said second stable configuration.

10. The assembly according to claim 9, wherein said disc is a stamping of sheet metal.

11. The assembly according to claim 9, further including an elastomeric bumper that covers said peripheral edge of said disc.

12. The assembly according to claim 11, wherein said disc has a plurality of holes formed therethrough proximate said peripheral edge.

13. The assembly according to claim 12, wherein said elastomeric bumper is molded through said plurality of holes.

14. The assembly according to claim 9, wherein said first axis line and said second axis line lay in a common plane.

15. The assembly according to claim 9, further including a first layer of protective material covering said at least a portion of said top surface and a second layer of protective material covering at least a portion of said bottom surface.

16. The assembly according to claim 15, wherein said first layer of protective material and said second layer of protective material are lenticular films.

* * * * *